United States Patent [19]

Müller et al.

[11] 4,313,724

[45] Feb. 2, 1982

[54] CERAMIC BURNER FOR USE IN AN AIR HEATER

[75] Inventors: Rudolf Müller, Merzenich; Hans Kuckertz; Erich Marx, both of Düren, all of Fed. Rep. of Germany

[73] Assignee: Hermann Rappold & Co. GmbH, Düren, Fed. Rep. of Germany

[21] Appl. No.: 111,302

[22] Filed: Jan. 11, 1980

[30] Foreign Application Priority Data

Jan. 27, 1979 [DE] Fed. Rep. of Germany ..... 2903147

[51] Int. Cl.[3] ..... F28C 3/10

[52] U.S. Cl. ..... 432/217; 431/170

[58] Field of Search ..... 431/171, 170; 432/217, 432/218

[56] References Cited

U.S. PATENT DOCUMENTS 4,086,052 4/1978 Laux et al. ..... 432/217

4,259,064 3/1981 Laux et al. ..... 432/217

OTHER PUBLICATIONS

"Iron and Steel Engineer", Mar. 1974, pp. 41-44.

*Primary Examiner*—Carroll B. Dority, Jr.

*Attorney, Agent, or Firm*—Wenderoth, Lind & Ponack

[57] ABSTRACT

A ceramic burner includes a fuel gas supply conduit having a gas delivery region opening into a mouth portion and a mixing and aspiration region communicating with the gas delivery region, and an air supply conduit having nozzles opening into the mixing and aspiration region of the fuel gas supply conduit. The mixing and aspiration region has an angular configuration including a first segment inclined with respect to the axis of a combustion chamber of an air heater within which the burner is positioned and a second segment inclined with respect to the first segment and in communication therewith at a position of directional change. The gas delivery region extends coaxially with respect to the combustion chamber. The nozzles of the air supply conduit include first and second sets of nozzles, the first set of nozzles being directed toward an opposite wall of the first segment of the mixing and aspiration region adjacent the position of directional change, and the second set of nozzles being directed toward the mouth portion. The gas delivery region has extending thereinto, at positions adjacent the mouth portion, a plurality of projections.

9 Claims, 5 Drawing Figures

CERAMIC BURNER FOR USE IN AN AIR HEATER

BACKGROUND OF THE INVENTION

The present invention relates to a ceramic burner for use in an air heater of the type including adjacent conduits for a heating or fuel gas and combustion air, wherein the gas supply conduit includes a mixing and intake or mixing and aspiration region which is inclined with respect to the axis of the combustion chamber of the air heater, and wherein the air supply conduit is provided with air discharge nozzles which open into the mixing and aspiration region of the gas supply conduit.

Ceramic burners of this type are known for use in various types of air heaters, such as recuperators, regenerators or hot-blast stoves, and are particularly employed to produce the hot air necessary for blast furnaces. In this operation however, problems arise when the heating or fuel gas is used at a low pressure or with rapidly varying heating or calorific values. Due to the high throughput and associated high pressure drop, the gas pressure in many gas supply systems for older type blast furnace installations is so low that known burners of the above-mentioned type cannot ensure trouble-free combustion of the heating or fuel gas. Moreover, this low gas pressure is in most gas supply systems subject to large fluctuations, for example when one or more user devices are switched in or out. Such pulsating gas streams can be employed for combustion without the necessity of additional measures only in systems with a low backpressure, for example in boiler houses. Such pulsating gas streams cannot be used however for heating in air heaters having a high pressure loss in the brickwork.

Additional difficulties are presented when the heating or calorific value of the heating or fuel gas fluctuates sharply. In practice, this fluctuation can range between 3000 and 5000 kJ/m$^3$. While at a low heating value a comparatively low amount of combustion air and about 30% more gas must be forced out, at a high heating value 1 Nm$^3$ of gas is associated with approximately 1.3 Nm$^3$ combustion air, with a higher nozzle outlet speed.

SUMMARY OF THE INVENTION

With the above discussion in mind, the primary object of the present invention is to provide an improved ceramic burner of the above generally described type but which always provides trouble-free combustion, even when heating or fuel gases with a low pressure and/or sharply fluctuating heating or calorific values are employed.

The above object is achieved in accordance with the present invention by providing that the mixing and aspiration region of the fuel gas supply conduit has an angular configuration including a first segment inclined with respect to the axis of the combustion chamber of the air heater in a direction toward the nozzles of the air supply conduit and a second segment inclined with respect to the first segment and in communication therewith at a position of directional change. The gas delivery region of the fuel gas supply conduit is in communication with the second segment of the mixing and aspiration region and is adapted to extend coaxially with respect to the combustion chamber of the air heater. The nozzles of the air supply conduit comprise a first set of nozzles and a second set of nozzles. The first set of nozzles are directed toward an opposite wall of the first segment of the mixing and aspiration region adjacent the position of directional change. The second set of nozzles are directed toward the mouth portion of the burner adjacent the combustion chamber of the air heater. The gas delivery region has extending thereinto, at positions adjacent the mouth portion, a plurality of projections.

By the above combination of structural elements it is possible to achieve an intensive intermixing of the combustible gas with the combustion air, since the air streams discharged from the first set of nozzles partially impinge on the opposite wall of the first segment of the mixing and aspiration region of the gas supply conduit and are there intensively mixed with the incoming stream or flow of heating or fuel gas. Additionally however, another part of the combustion air, i.e. that combustion air discharged from the second set of nozzles, is fully mixed in a downstream portion of the burner at a location above the position of directional change, due to the velocity vectors of the combustion air from the second set of nozzles and the heating gas joining at the downstream location. Even further however, the discharge of combustion air from the second set of nozzles creates a very strong aspirating action within the upstream portion of the fuel gas supply conduit, thereby improving the feed of fuel gas, since the second set of nozzles are directed at low incidence angles, thereby causing such nozzles to act almost exclusively as injector nozzles.

Yet further, the projections located in the gas delivery region prevent the formation and flow through the mouth portion of an undesirable free jet. Such a free jet would lead to pulsating and incomplete burning. The projections prevent such free jet from forming and make a substantial contribution to mixing of the air and fuel gas, and at a mixture gas throughput the projections provide the additional effect of flame retention or retardation.

The best mixing and aspiration effects can be achieved if the air discharge nozzles of the first set of nozzles are inclined with respect to the axis of the combustion chamber at an angle of from 30° to 50°, and if the air discharge nozzles of the second set of nozzles extend with respect to the axis of the combustion chamber at an angle of from 0° to 10°, and if the first segment of the mixing and aspiration region of the fuel gas supply conduit is inclined with respect to the axis of the combustion chamber at an angle of from 20° to 40°.

In accordance with a further feature of the present invention, it is advantageous if the angles of inclination of the nozzles and the mixing and aspiration region of the fuel gas supply conduit are such that the velocity vectors of the air exiting from the nozzles and the gas stream meet in the center or middle of the mouth portion adjacent the combustion chamber.

In accordance with an even further feature of the present invention, the nozzles of the first and second sets of nozzles are alternatively arranged at approximately the same axial level with respect to and along the axis of the combustion chamber.

Further, the projections extending into the gas delivery region of the fuel gas supply conduit comprise at least one set or row of refractory bricks. Preferably, there are provided a plurality of rows of refractory bricks, with the bricks of each row being staggered with respect to the bricks of each adjacent row. Further preferably, the bricks are movable into and away from the gas delivery region, to thereby allow for an optimal adjustment of the effect of the projections for various throughput or volume flow rates.

In order to reduce the pressure loss in the combustion air and the combustible gases, the body of the burner is formed of a single integral member in a shell-type structure and formed of a refractory stamping mass material, for example known such stamping mass clay materials. Thereby, it is possible to provide that the fuel gas supply conduit and the air supply conduit are formed of smooth walls which thus reduce the amount of pressure loss within the burner. The discharge nozzles may be fabricated within the material of the body of the burner with the aid of cores, for example Styrofoam cores. Wall stability of the shell-type structure is achieved with the aid of reinforcing members, such as ring anchors and structural steel mats.

BRIEF DESCRIPTION OF THE DRAWINGS

Other objects, features and advantages of the present invention will become apparent from the following detailed description, taken with the accompanying drawings, wherein.

DETAILED DESCRIPTION OF THE INVENTION

With reference now to the drawings, there is shown a combustion chamber 1 of an air heater. Combustion chamber 1 is bounded by outer brickwork 2 and a separating wall 3 of refractory material. Separating wall 3 separates the combustion chamber 1 from the checkerwork of the air heater (not shown) in a manner known in the art.

Figure 3:
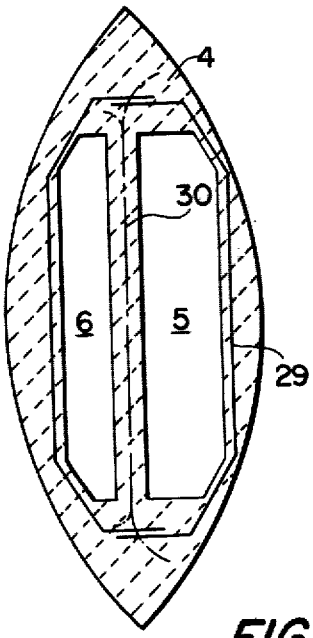
FIG. 3 is a cross-sectional view taken along line III—III of FIG. 1.

The improved ceramic burner 4 according to the present invention is located within the air heater at the lower end of the combustion chamber 1. The burner 4 is provided internally with a heating or fuel gas supply conduit 5 which eventually opens through a mouth portion 21 into combustion chamber 1. Burner 4 is furthermore internally provided with a combustion air supply conduit 6 which generally extends parallel to conduit 5. Gas supply conduit 5 and air supply conduit 6 each have a generally rectangular cross section, as is particularly shown in FIG. 3 of the drawings, and are in fluid communication with suitable fuel gas and air main supply lines (not shown) via suitable connections such as coaxial connecting conduits 7 and 8, respectively.

Fuel gas supply conduit 5 generally includes three sequentially connected regions, i.e. gas entrance region 9, mixing and aspiration region 10, and gas delivery region 11. Gas entrance region 9 extends parallel to the axis of combustion chamber 1. Mixing and aspiration region 10 has an angular configuration including a first segment 14 inclined with respect to the axis of the combustion chamber in a direction toward the air supply conduit and a second segment 15 inclined with respect to the first segment 14 at a position 13 of directional change. Thus, mixing and aspiration region 10 includes two generally linear segments 14 and 15 which extend at an angle with respect to each other at point or position 13. Preferably, upstream segment 14 and downstream segment 15 are inclined in opposite directions with respect to the axis 12 of the combustion chamber 1. In the arrangement illustrated in FIG. 1, the angles of inclination 16 and 17 of segments 14 and 15, respectively, are both approximately 30°, but may be from 20° to 40°. Gas delivery region 11 of the fuel gas supply conduit 5 extends parallel to the axis 12 of combustion chamber 1 and opens thereinto via mouth portion 21.

Figure 2:
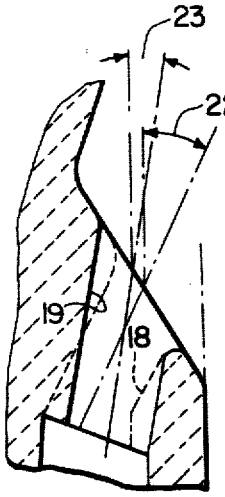
FIG. 2 is an enlarged cross-sectional view of that portion of FIG. 1 denoted by II.
Figure 5:
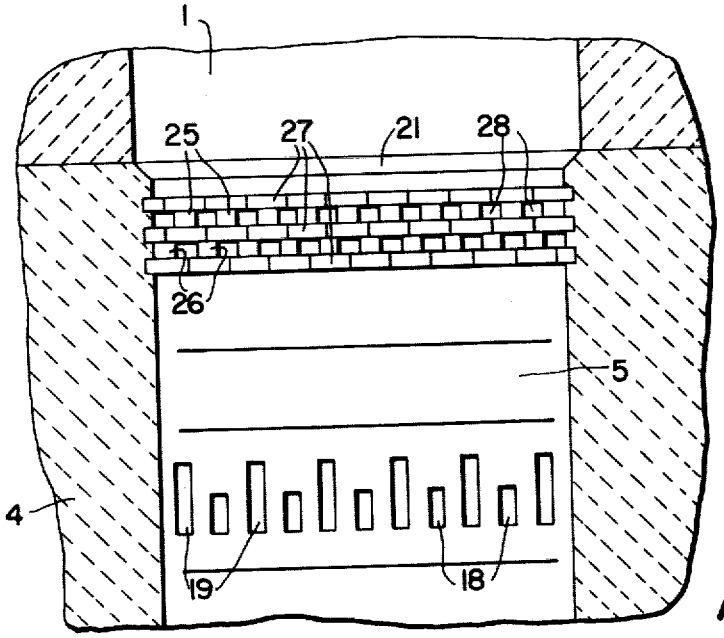
FIG. 5 is a cross-sectional view taken along line V—V of FIG. 1.
Figure 4:
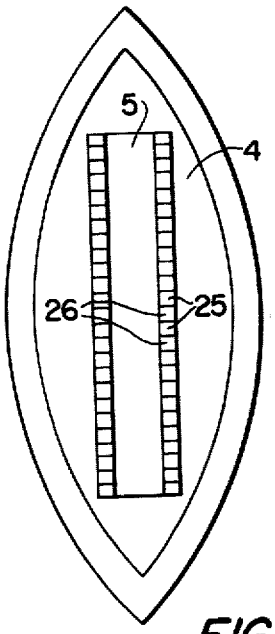
FIG. 4 is a top view, on a reduced scale, of the arrangement shown in FIG. 1.

Air supply conduit 6 is provided with two sets of air discharge nozzles, i.e. a first set 18 and a second set 19, as seen more clearly in FIGS. 2 and 5 of the drawings. The nozzles 18 of the first set extend at a different angle of inclination than the nozzles 19 of the second set. Nozzles 18 and 19 of both sets are located at approximately the same axial position with respect to the axis of the system, i.e. at approximately the same altitude or level of the burner 4. Also, as particularly shown in FIG. 5, the nozzles 18 and 19 are preferably arranged to alternate.

The nozzles 18 and 19 all open outwardly into the mixing and aspiration region 10 of the gas supply conduit 5. However, the nozzles 18 of the first set are directed toward the opposite wall 20 of first segment 14 of mixing and aspiration region 10 at a location adjacent the position of directional change 13. On the other hand, the nozzles 19 of the other set are directed toward the mouth portion 21 of the burner, i.e. at the downstream-most end of the gas supply conduit 5. The angles of inclination 22 and 23 of nozzles 18 and 19, respectively, with respect to the center axis 12 of combustion chamber 1 are preferably approximately 30° and 10°, respectively. Thus, the angle 24 (FIG. 1) between the axes of nozzles 18 and 19 is 20°. However, the angle of inclination 22 may be from 30° to 50°, and the angle of inclination 23 may be from 0° to 10°.

Figure 1:
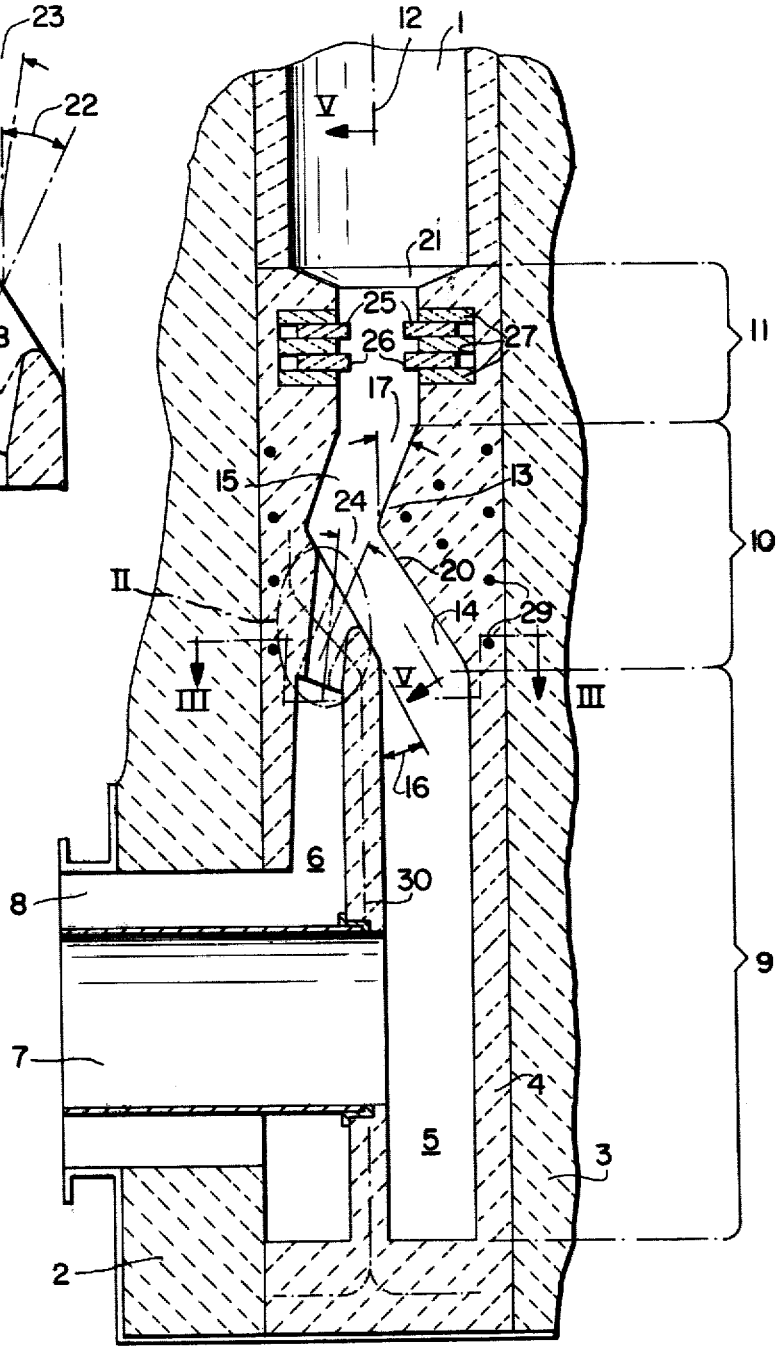
FIG. 1 is a longitudinal cross-sectional view through a ceramic burner according to the present invention.

Within the gas delivery region 11 of the fuel gas supply conduit 5, at a location slightly below the burner mouth 21, there are provided, preferably on opposite sides of gas delivery region 11, a plurality of projections. Preferably, these projections comprise at least one row of refractory bricks, and further preferably these projections comprise, on each side of the gas delivery region 11, two rows or layers 25 and 26 of refractory bricks, with the bricks of the two layers 25 and 26 being horizontally staggered with respect to each other, as particularly seen in FIG. 5 of the drawings. Each of the two layers 25 and 26 is positioned between adjacent additional layers 27 of bricks, such that there are provided three layers 27 on each side of gas delivery region 11. The bricks of layers 25 and 26 form projections extending into the gas delivery region 11, as particularly shown in FIG. 1 of the drawings. Furthermore, the bricks of the layers 25 and 26 are provided such that adjacent bricks of the layers are spaced by gaps 28, as particularly seen in FIG. 5 of the drawings. Furthermore, the bricks of layers 25 and 26 are movable into and out of the gas delivery region 11, i.e. movable horizontally as shown in FIG. 1 of the drawings. This makes it possible to adjust the relative extent of projection of the bricks of layers 25 and 26, thereby making a single or rough adjustment of the extent of the action of the projections with respect to the throughput or rate of the burner.

Preferably, the burner 4 is formed as a single integral member which is slidably positionable with the air heater. Preferably, such integral member has a shell-type structure formed of a refractory stamping mass material. Those skilled in the art will understand what types of materials may be employable as a refractory stamping mass to form a compacted solid integral refractory member. Air discharge nozzles 18 and 19 are fabricated within the integral shell-type structure of the burner 4 with the aid of a core material, such as Styrofoam cores. Wall stability of the shell-type structure is achieved by means of reinforcing members, for example ring anchors 29 and structural steel mats 30 (see FIGS. 1 and 3).

As will be apparent from FIG. 1 of the drawings, air discharge nozzles 18 of the first set are inclined such that the air streams discharged therefrom partly impinge on the opposite wall 20 of first segment 14 of mixing and aspiration region 10 of gas supply conduit 5, in a location adjacent the position 13 of directional change of the segments of the mixing and aspiration region 10. By this arrangement, strong interior intermixing of the fuel gas with the combustion air is achieved.

On the other hand, nozzles 19 of the second set are directed such that the streams resulting from the velocity vectors of the gas stream rising through the gas supply conduit 5 and the air streams discharged from the nozzles join at the center of the combustion chamber 1 at a position within the burner tip 21. Further, due to the inclination of air discharge nozzles 19, there is produced by the air discharged therefrom a very strong aspiration effect. Thereby, the combustion air draws along or aspirates sufficient fuel gas through the gas entrance region 9 and first segment 14 to ensure a trouble-free and steady combustion, even when the heating or fuel gas is supplied at a low pressure. This aspiration achieved by the inclination of air discharge nozzles 19 also ensures that when the supplied heating or fuel gas has a sharply varying heating or calorific value, the requisite additional amount of gas is forced along when the instantaneous heating or calorific value is low.

The projections formed by layers 25 and 26 of refractory bricks act as control and flame retention bricks. Specifically, these projections prevent the central stream from penetrating into the combustion chamber as an unhindered free jet. Such a free jet would lead to pulsation and incomplete combustion. Any such central, free flowing jet is retarded or prevented by the projections, and this creates the necessary conditions such that the combustion air mixes intensively with the fuel gas, even in the area of the gas delivery region 11. Thereby, the gas will be combusted with a short flame at the burner mouth 21 when the ignition temperature is supplied.

It will be understood by those skilled in the art from the above discussion that the mixing and aspiration effect of the burner can be optimized as necessary according to the specific operating conditions involved, that is according to the gas pressure and/or heating or calorific value of the heating gas used, by changing the angles 16, 17, 22 and 23, and/or by changing the cross-sectional ratios of gas supply conduit 5 and air discharge nozzles 18 and 19. It has so far been determined that the best results are achieved when the angles 16 and 17 are from 20° to 40°, the angle 22 is from 30° to 50°, and the angle 23 is from 0° to 10°.

It will be further understood by those skilled in the art, from the above discussion, that additional control of the mixing and aspiration effect in the burner can be achieved by appropriate adjustment of the control and flame retention projections formed by the sets 25 and 26 of refractory bricks.

A significant feature of the present invention, as discussed above, is that the only refractory bricks provided in the burner are those bricks forming the flame control and retention bricks in the upper part of the burner. The major portion of the burner itself is constructed as a single integral member of a refractory stamping mass material. This results in minimal pressure loss within the burner, and additionally results in the design of the burner being more economical than if formed by a masonry construction.

Although the present invention has been described and illustrated with respect to a preferred embodiment thereof, it will be understood by those skilled in the art that various modifications may be made without departing from the scope of the present invention.

What we claim is:

1. In a ceramic burner for use in an air heater of the type including an axially extending combustion chamber, said burner including a mouth portion adapted to open into the combustion chamber of the air heater, a fuel gas supply conduit having a gas delivery region opening into said mouth portion and a mixing and aspiration region communicating with said gas delivery region and adapted to extend in a direction inclined with respect to the axis of the combustion chamber of the air heater, and an air supply conduit having nozzles opening into said mixing and aspiration region of said fuel gas supply conduit, the improvement wherein:

said mixing and aspiration region of said fuel gas supply conduit has an angular configuration including a first segment inclined with respect to the axis of the combustion chamber in a direction toward said nozzles of said air supply conduit and a second segment inclined with respect to said first segment and in communication therewith at a position of directional change;

said gas delivery region of said fuel gas supply conduit is in communication with said second segment of said mixing and aspiration region and is adapted to extend coaxially with respect to the combustion chamber of the air heater;

said nozzles of said air supply conduit comprise a first set of nozzles and a second set of nozzles, said first set of nozzles being directed toward an opposite wall of said first segment of said mixing and aspiration region adjacent said position of directional change, and said second set of nozzles being directed toward said mouth portion; and said gas delivery region having extending thereinto, at positions adjacent said mouth portion, a plurality of projections.

2. The improvement claimed in claim 1, wherein said first set of nozzles are inclined with respect to the axis of the combustion chamber at an angle of from 30° to 50°, said second set of nozzles extend with respect to the axis at an angle of from 0° to 10°, and said first segment of said mixing and aspiration region is inclined with respect to the axis at an angle of from 20° to 40°.

3. The improvement claimed in claims 1 or 2, wherein said second segment of said mixing and aspiration region and said second set of nozzles are inclined with respect to the axis of the combustion chamber at respective angles and directed downstream of said second segment of said mixing and aspirating region toward said mouth portion.

4. The improvement claimed in claims 1 or 2, wherein said nozzles of said first and second sets of nozzles are alternately arranged at approximately the same axial level with respect to the axis of the combustion chamber.

5. The improvement claimed in claim 1, wherein said projections comprise at least one row of refractory bricks.

6. The improvement claimed in claim 5, wherein said projections comprise a plurality of rows of refractory bricks, said bricks of each said row being staggered with respect to said bricks of each adjacent said row.

7. The improvement claimed in claims 5 or 6, wherein said bricks are movable into and away from said gas delivery region.

8. The improvement claimed in claim 1, wherein said burner comprises a shell-type structure adapted to be slidably inserted into the air heater.

9. The improvement claimed in claim 8, wherein said shell-type structure is an integral member formed of a refractory stamping mass material.

* * * * *